United States Patent [19]

Klein

[11] Patent Number: 4,478,278

[45] Date of Patent: Oct. 23, 1984

[54] SPACER FOR DEEP WELLS

[75] Inventor: George D. Klein, Thorsby, Canada

[73] Assignee: Texaco Canada Resources Ltd., Calgary, Canada

[21] Appl. No.: 325,534

[22] Filed: Nov. 27, 1981

[51] Int. Cl.[3] ..... E21B 43/00

[52] U.S. Cl. ..... 166/105; 166/65 R; 166/241; 174/47; 138/108; 138/113

[58] Field of Search ..... 166/65 R, 105, 68, 94, 166/241; 175/104, 105, 325; 285/137 A, 137 R; 174/47, 99 R; 248/74 R; 138/108, 112, 113

[56] References Cited

U.S. PATENT DOCUMENTS

| | | | |
|---|---|---|---|
| 2,253,092 | 8/1941 | Pranger | 166/65 R |
| 2,670,802 | 3/1954 | Ackley | 166/60 |
| 2,829,190 | 4/1958 | Comlossy, Jr. | 174/47 |
| 3,052,748 | 9/1962 | Curtiss | 174/65 R |
| 3,835,929 | 9/1974 | Suman, Jr. | 166/65 R |
| 3,912,008 | 10/1975 | Crowe | 166/217 |
| 3,940,832 | 3/1976 | Kelly et al. | 174/47 |
| 4,004,326 | 1/1977 | Beavers | 166/241 |

*Primary Examiner*—Ernest R. Purser
*Assistant Examiner*—Hoang C. Dang
*Attorney, Agent, or Firm*—Carl G. Ries; Robert A. Kulason; Henry C. Dearborn

[57] ABSTRACT

A spacer for use in a deep well that is to have a submersible pump situated downhole and with a string of tubing attached to the pump for delivering the pumped fluid. The pump is electrically driven, and power is supplied via an armored cable which parallels the string of tubing. Spacers are clamped to the cable and have the tubing running through an eccentrically located passage in each spacer. The outside dimensions of a spacer fit freely inside any casing in the well.

7 Claims, 3 Drawing Figures

SPACER FOR DEEP WELLS

BACKGROUND OF THE INVENTION

1. Field of the Invention

This invention concerns a spacer structure that is applicable to equipment used in a deep well. More specifically, it concerns a spacer that will be employed in connection with a submersible pump that is driven by electric power. The pump is lowered into a deep well along with tubing that is connected to the pump for recovering the pumped fluid and an electric cable for supplying power to drive the pump.

2. Description of the Prior Art

In making use of a submersible pump in a deep well wherein the pump is driven by an electric motor, the necessity for an electric cable to transmit the power to the electrical drive of the pump, has created a problem. There is a tendency to damage the electrical cable as the pump is lowered into place in a deep well. The pump is attached to a string of tubing which is quite rigid, while the electrical cable is relatively flexible and subject to damage even though an armoured type cable is used.

Thus, it is an object of this invention to provide a spacer structure that may be employed at particular intervals as a submersible pump, with its tubing string, is lowered into the hole. Such spacers are clamped onto the electrical cable and provide for the tubing to pass through in parallel but separated from the cable.

SUMMARY OF THE INVENTION

Briefly, the invention relates to and is in combination with a deep well having a casing therein and employing a submersible electrically driven pump downhole. Also the combination includes tubing connected to said pump outlet for delivering pumped fluid to the surface, and an electrical cable for supplying energy to drive said pump. In combination with the foregoing, there is spacer means for holding said cable out of contact with said casing and said tubing while said pump is lowered into said well.

Once more briefly, the invention is in combination with a deep well having a casing therein and employing a submersible electrically driven pump downhole. Also the combination has tubing connected to said pump outlet for delivering pumped fluid to the surface, and electrical cable for supplying energy to drive said pump. The invention includes cylindrical spacer means having an outside diameter less than the inside diameter of said casing, and a longitudinal passage through said spacer parallel to the axis of said well and having an inside diameter greater than the outside diameter of said tubing. The said electrical cable has an armoured exterior forming a corrugated surface, and there is clamping means integral with said cylindrical spacer. The said clamping means comprises a longitudinal opening parallel to said longitudinal passage and having an interior corrugated surface for mating with said cable exterior. The clamping means also comprises a chordal section of said cylindrical spacer for splitting said longitudinal opening lengthwise, and means for securing said chordal section in place for clamping said spacer onto said cable.

Again briefly, the invention concerns a spacer for use in a cased well having a submersible pump with an electric cable for supplying power to drive said pump, and tubing for carrying the output of said pump up said well. The spacer comprises a solid cylindrical body having an outside diameter less than the inside diameter of said well casing, and an eccentrically located longitudinal passage through said body having an inside diameter greater than the outside diameter of said tubing. It also comprises a split clamp formed by a chordal section of said body and having an interior surface configuration adapted to match the exterior of said cable.

BRIEF DESCRIPTION OF THE DRAWINGS

The foregoing and other objects and benefits of the invention will be more fully set forth below in connection with the best mode contemplated bby the inventor of carrying out the invention, and in connection with which there are illustrations provided in the drawings, wherein.

DESCRIPTION OF THE PREFERRED EMBODIMENT

Figure 1:
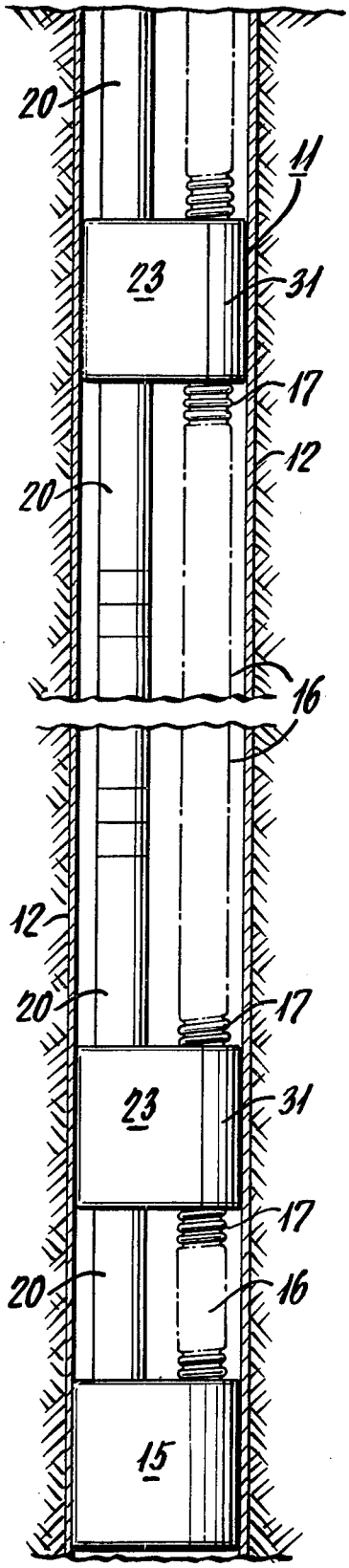
FIG. 1 is a schematic cross-sectional view of portions of a deep well, with elements according to the invention shown therein.

As illustrated in FIG. 1, there is indicated a deep well 11 that has a casing 12 therein and that has a submersible pump 15 down in the well 11. The pump 15 is schematically indicated. It will be understood that pump 15 indicated includes an electric motor (not shown) for driving the pump. Consequently there is an electric cable 16 that is connected to the pump unit 15 for supplying the energy to drive the pump. The cable 16 has an armoured exterior surface 17 that is formed as a spiral which creates a corrugated surface.

Also connected to the pump unit 15 there is a string of tubing 20 that acts to deliver the pumped fluid to the surface of the well 11. A spacer 23 according to this invention is periodically attached to the cable 16 and has the tubing 20 passing therethrough. It will be appreciated that the outside diameter of each spacer 23 is less than the inside diameter of the casing 12, in order that the spacers 23 may move freely down inside the casing while acting to guide and maintain the cable 16 and tubing 20 in parallel relationship and free from damage as the pump is lowered into the hole.

Figure 2:
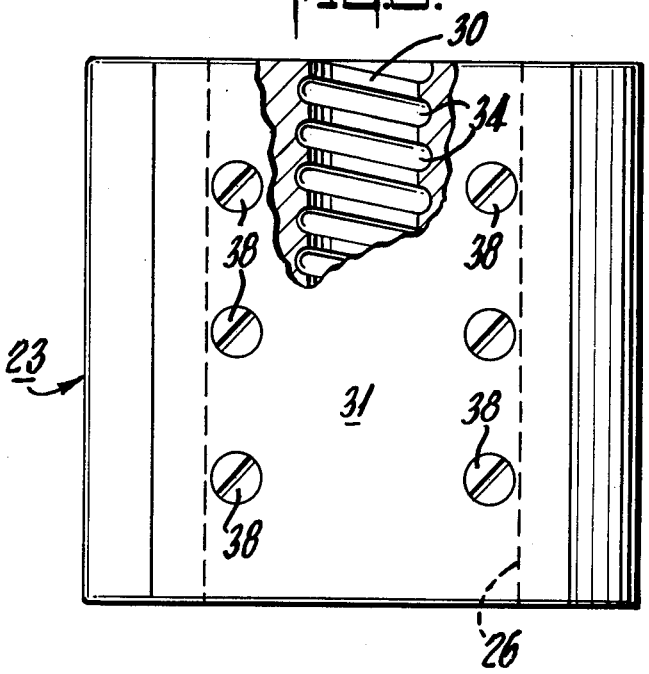
FIG. 2 is an enlarged side elevation, partly broken away in cross-section, showing one of the spacer elements according to the invention.
Figure 3:
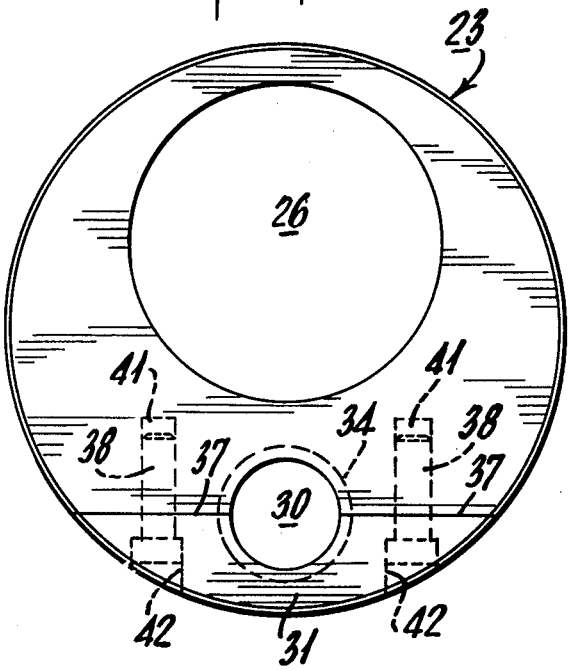
FIG. 3 is a plan view of the spacer element illustrated in FIG. 2.

A spacer 23 is shown somewhat enlarged in FIGS. 2 and 3. It is preferably constructed from heat treated steel, and it is formed as a cylinder that has the outside diameter with the relative dimensions indicated above. There is a longitudinal passage 26 (FIG. 3) that is eccentrically located relative to the cylindrical body of spacer 23. This passage 26 is designed to accommodate the tubing 20 for permitting the tubing 20 to pass freely therethrough. There is another longitudinal opening 30 that is parallel to the passage 26, and that forms a clamping means for engaging the cable 16 so as to hold the spacer 23 onto the cable 16 at each location.

The clamping means is in the form of a split clamp that is created by a chordal section 31 of the cylindrical spacer 23. The opening 30 has an interior surface configuration 34 that has corrugations for matching the exterior corrugations 17 of the cable 16. Also, there is a flat surface 37 on both section 31 and the body of the spacer 23 where the chordal section 31 meets the body of the spacer 23. And, there are a plurality of bolts 38 that are screwed into internally threaded holes 41 located in the body of the spacer 23, as indicated in FIG. 3. Of course, the heads of the bolts 38 are countersunk by having counter bores 42 drilled into the section 31 so as to leave the outer surface of the entire spacer body 23 smooth, i.e. without any protuberance.

It will be understood that spacers according to this invention are effective to centralize the tubing and cable as the submersible pump is run down into the well. Such use of spacers holds the electrical cable away from the casing and eliminates wear and/or damage to the cable particularly while running the tubing and pump, with cable attached, down into the hole.

While a particular embodiment of the invention has been described above in considerable detail in accordance with applicable statutes, this is not to be taken as in any way limiting the invention but merely as being descriptive thereof.

The embodiments of the invention in which an exclusive property or privilege is claimed are defined as follows:

1. In combination with a deep well having an axis and a casing therein and employing a submersible electrically driven pump having an outlet downhole, tubing connected to said pump outlet for delivering pumped fluid to the surface, and electrical cable for supplying energy to drive said pump, the improvement comprising spacer means for holding said cable out of contact with said casing and said tubing while said pump is lowered into said well, said cable having an uneven exterior surface, said spacer means comprising means for clamping onto said cable to prevent relative movement between said spacer means and said cable, said clamping means having a complementary uneven interior surface, and longitudinal passage means through said spacer means for permitting said tubing to pass freely there through.

2. The invention according to claim 1, wherein said longitudinal passage means is parallel to the axis of said well.

3. The invention according to claim 2, wherein said spacer means is cylindrical and has an outside diameter less than the inside diameter of said casing.

4. The invention according to claim 3, wherein said clamping means comprises a longitudinal opening parallel to said longitudinal passage.

5. The invention according to claim 4, wherein said cable exterior surface is corrugated, and said longitudinal opening has an interior corrugated surface for mating with said cable exterior surface.

6. The invention according to claim 5, wherein said clamping means also comprises a removable section of said cylindrical spacer for longitudinally splitting said longitudinal opening.

7. In combination with a deep well having an axis and a casing therein and employing a submersible electrically driven pump having an outlet downhole, tubing connected to said pump outlet for delivering pumped fluid to the surface, and electrical cable for supplying energy to drive said pump, cylindrical spacer means having an outside diameter less than the inside diameter of said casing, a longitudinal passage through said spacer means parallel to the axis of said well and having an inside diameter greater than the outside of said tubing, said electrical cable having an armoured exterior forming a corrugated surface, and clamping means integral with said cylindrical spacer means, said clamping means comprising a longitudinal opening parallel to said longitudinal passage and having an interior corrugated surface for mating with said cable exterior, a chordal section of said cylindrical spacer means for splitting said longitudinal opening lengthwise, and means for securing said chordal section in place for clamping said spacer means onto said cable.

* * * * *